US005522458A

United States Patent [19]

Watson et al.

[11] Patent Number: 5,522,458

[45] Date of Patent: Jun. 4, 1996

[54] HIGH PRESSURE CEMENTING PLUG ASSEMBLIES

[75] Inventors: Brock W. Watson, Baird, Tex.; David P. Brisco, Duncan, Okla.

[73] Assignee: Halliburton Company, Duncan, Okla.

[21] Appl. No.: 292,893

[22] Filed: Aug. 18, 1994

[51] Int. Cl.[6] ..... E21B 33/16

[52] U.S. Cl. ..... 166/202; 166/156

[58] Field of Search ..... 166/153, 154, 166/155, 156, 317, 291

[56] References Cited

U.S. PATENT DOCUMENTS

| | | | |
|---|---|---|---|
| 3,437,137 | 4/1969 | Scott | 166/153 |
| 3,545,542 | 12/1970 | Scott | 166/156 X |
| 3,796,260 | 3/1974 | Bradley | 166/153 |
| 4,078,810 | 3/1978 | Arendt | 277/116.4 |
| 4,083,074 | 4/1978 | Curtis | 15/104.06 R |
| 4,190,112 | 2/1980 | Davis | 166/291 |
| 4,356,865 | 11/1982 | Appel et al. | 166/153 |
| 4,624,312 | 11/1986 | McMullin | 166/155 |
| 4,809,776 | 3/1989 | Bradley | 166/153 |
| 4,836,279 | 6/1989 | Freeman | 166/153 |
| 4,858,687 | 8/1989 | Watson et al. | 166/153 |
| 5,018,579 | 5/1991 | Braddick et al. | 166/155 X |
| 5,052,488 | 10/1991 | Fraser, III | 166/155 X |
| 5,095,980 | 3/1992 | Watson | 166/192 |

*Primary Examiner*—Frank S. Tsay

*Attorney, Agent, or Firm*—Craig W. Roddy; Stephen R. Christian; C. Clark Dougherty, Jr.

[57] ABSTRACT

A high pressure well cementing plug assembly for use in a pipe during the cementing of the pipe in a well bore is provided by the present invention. The assembly basically comprises top and bottom cementing plugs which include high strength inner tubes for supporting high differential pressures exerted on the plugs. The bottom end of the inner tube of the bottom plug is adapted to supportingly engage a float shoe or the like upon landing. Also, the bottom end of the inner tube of the top plug and the top end of the inner tube of the bottom plug are adapted to supportingly engage each other when the top plug lands on the bottom plug. The high strength inner tubes support high pressure differentials exerted on the plugs and prevent the plugs from collapsing or otherwise being damaged.

18 Claims, 6 Drawing Sheets

HIGH PRESSURE CEMENTING PLUG ASSEMBLIES

BACKGROUND OF THE INVENTION

1. Field of the Invention

This invention relates to well cementing plug assemblies for use in a pipe such as casing during the cementing of the pipe in a well bore, and more particularly, to such plug assemblies which can support high pressure differentials without damage.

2. Description of the Prior Art

In the primary cementing of a well, a cement slurry is pumped downwardly through the pipe to be cemented in the well and then upwardly into the annulus between the pipe and the walls of the well bore. Upon setting, the cement bonds the pipe to the walls of the well bore and restricts fluid movement between formations penetrated by the well bore.

At the commencement of primary cementing, the pipe to be cemented and well bore are usually filled with drilling mud. In order to reduce contamination of the cement slurry at the interface between the drilling mud and cement slurry, a plug which includes a plurality of elastomeric wipers for sealingly engaging the inner surface of the pipe is pumped ahead of the cement slurry whereby the cement slurry is separated from the drilling mud as they are displaced through the pipe. The plug wipes the drilling mud from the walls of the pipe ahead of the cement slurry and maintains the separation between the cement slurry and drilling mud until it lands on a float collar or float shoe attached to the bottom end of the pipe.

The bottom plug can include a rupturable member or when it lands it can open a valve mechanism which allows the cement slurry to proceed through the plug and upwardly into the annular space between the pipe and the well bore. When the required quantity of the cement slurry has been pumped into the pipe, a top plug is released into the pipe to separate the cement slurry from additional drilling mud or other fluid used to displace the cement slurry down the pipe.

The design of the top plug is such that when it lands on the bottom plug it shuts off fluid flow through the plugs which prevents the displacement fluid from entering the annulus. When the top plug lands, the usual practice is to continue pumping the displacement fluid into the pipe whereby the pipe is pressured up and the pipe and associated equipment including the pump are pressure tested for leaks or other defects. A valve in the float collar or float shoe prevents the reverse movement of the cement slurry through the pipe. Once the cement has set, the top and bottom plugs are usually drilled out of the pipe.

The top and bottom cementing plugs can be released from an above ground cement plug container which is installed in communication with the interior of the pipe to be cemented. Such plug containers and their operation are well known to those skilled in the art. In an alternate arrangement, a sub-surface release plug assembly can be utilized which is positioned in the pipe to be cemented and attached to the lower end of a drill string suspended therein. Sub-surface release cementing plug assemblies are commonly utilized in sub-sea primary cementing operations. In such operations, the cement slurry is pumped through the drill string to the sub-surface release cementing plug assembly.

A problem which can be experienced when cementing plugs of either the above surface release type or the sub-surface release type are used involves the collapse or damage to the cementing plugs as a result of high differential pressures exerted on the plugs during the cementing operation, particularly during the pressure test described above. That is, when primary cementing is carried out in a well, the pressure differential exerted on a cementing plug can be as high as 15,000 psi or greater. Such high pressure differentials have heretofore caused the collapse or other damage to the cement plugs which prevent their proper operation and which can be very costly to correct. Thus, there is a need for improved well cementing plugs and assemblies which can withstand high pressures without damage to the plugs and/or causing the improper operation thereof.

SUMMARY OF THE INVENTION

The present invention provides improved high pressure well cementing plug assemblies for use in the cementing of pipe in wells which meet the need described above and overcome the shortcomings of the prior art. The improved high pressure well cementing plug assemblies of this invention are basically comprised of top and bottom cementing plugs having high strength inner tubes attached thereto for supporting the differential pressures exerted on the plugs. The bottom end of the high strength inner tube of the top plug and the top end of the high strength inner tube of the bottom plug are adapted to supportingly engage each other when the top plug lands on the bottom plug. The bottom end of the high strength inner tube extending through the bottom plug is adapted to supportingly engage a float collar, float shoe or other similar structure attached to the pipe to be cemented at its lower end.

Thus, when the top and bottom cementing plugs have landed, the differential pressures exerted on the plugs are supported by high strength inner tubes which engage the float collar or float shoe and each other. In a preferred embodiment, the float collar or float shoe which is utilized with the improved top and bottom plugs also includes a high strength inner tube for supporting the differential pressures exerted thereon.

It is, therefore, a general object of the present invention to provide improved well cementing plug assemblies which can withstand high pressure differentials without damage.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
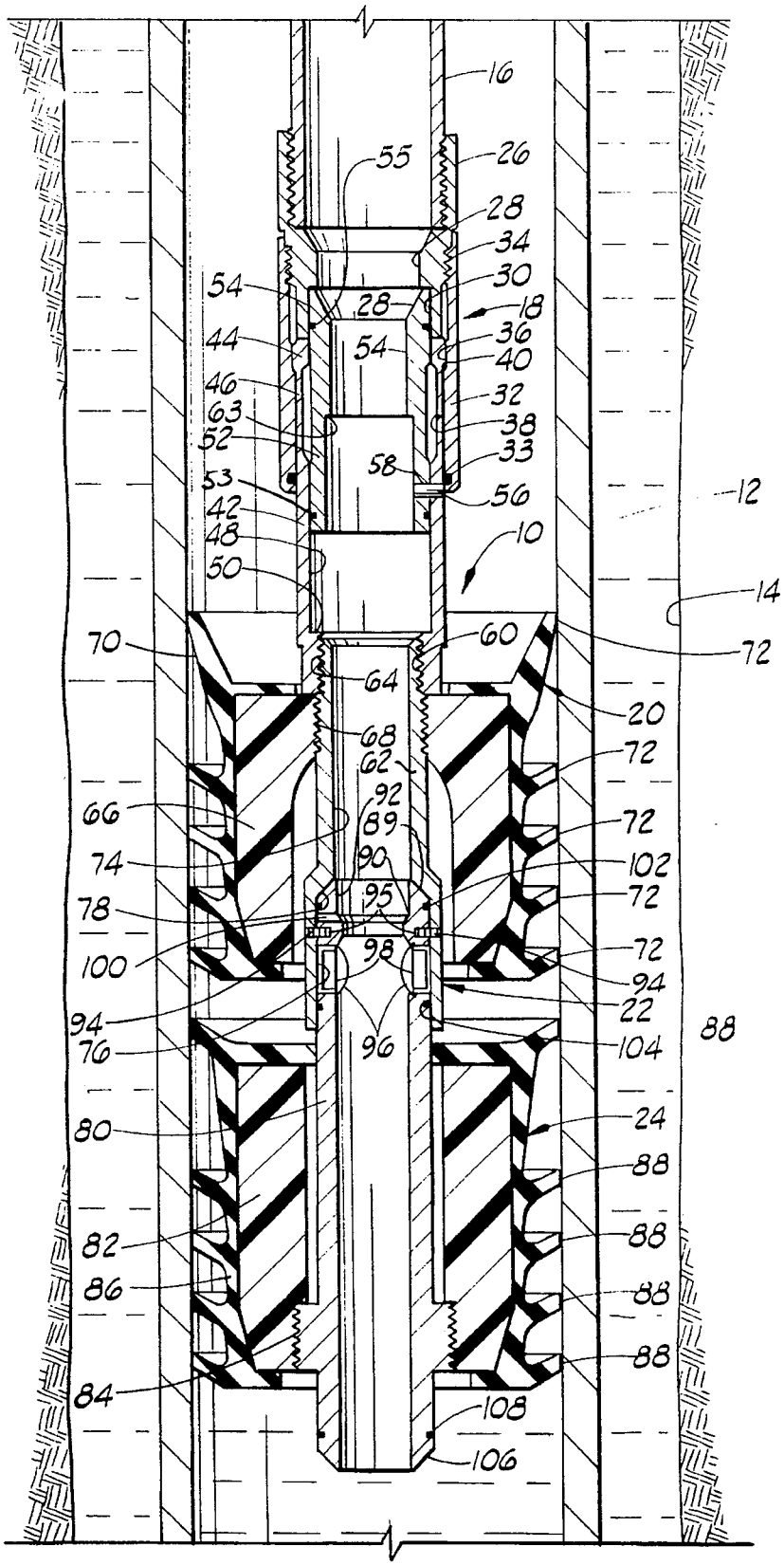
FIG. 1 is a side cross-sectional view of a well bore and a pipe to be cemented therein having a sub-surface release cementing plug assembly of the present invention installed in its initial position in the pipe.

Referring now to the drawings and particularly to FIG. 1, a sub-surface release well cementing plug assembly of the present invention is illustrated and generally designated by the numeral 10. The plug assembly 10 is shown positioned within a pipe 12 which is to be cemented in a well bore 14. The plug assembly 10 is in its initial position in the pipe 12 releasably connected to the lower end of a drill string 16.

The plug assembly 10 is comprised of a first fluid pressure activated releasing assembly 18 which is connected to the drill string 16, a top cementing plug 20 releasably connected to the assembly 18, a second fluid pressure activated releasing assembly 22 connected to the top cementing plug 20, and a bottom cementing plug 24 releasably connected to the assembly 22.

The first fluid pressure activated releasing assembly 18 includes a connector 26 which is threadedly connected to the lower end of the drill string 16. The connector 26 defines a first internal bore 28 and a second larger internal bore 30. The connector 26 is connected to a collet retainer 32 at an external threaded connection 34 thereon. The collet retainer 32 defines a first internal bore 36 and a second internal bore 38 with an annular beveled shoulder 40 inbetween.

The upper end of a collet 42 is disposed in the collet retainer 32 below the connector 26 so that the head portions 44 of a plurality of collet fingers 46 engage and are retained by the annular shoulder 40 in the collet retainer 32. The collet 42 defines an internal bore 48 and has a generally upwardly facing shoulder 50 at the lower end of the bore 48.

A releasing sleeve 52 is slidably disposed in, and has an outer surface 54 in close spaced relationship with, the second bore 30 of the connector 26 and the bore 48 of the collet 42. The releasing sleeve 52 includes a beveled shoulder 57 at its upper end which connects to an internal bore 59. A second enlarged bore 61 connects with the smaller bore 59 whereby an internal downwardly facing shoulder 63 is formed in the releasing sleeve 52. As will be understood by those skilled in the art, in the position illustrated in FIG. 1 the releasing sleeve 52 keeps the head portions 44 of the collet fingers 46 engaged with the annular shoulder 40 of the collet retainer 32.

At least one shear pin 56 is engaged with the collet 42 and extends into a recess 58 in the releasing sleeve 52 whereby the releasing sleeve 52 is held in the upper collet retaining position shown in FIG. 1.

An O-ring seal 33 is disposed in a groove positioned adjacent the lower end and in the interior of the collet retainer 32 to provide a seal between the collet retainer 32 and the collet 42 whereby fluids outside the releasing assembly 18 do not leak into the interior thereof. Also, a pair of O-ring seals 53 and 55 are disposed in grooves positioned adjacent the ends and in the exterior of the releasing sleeve 52 to provide a seal around the collet heads 44 and fingers 46. The O-ring seals 33, 53 and 55 insure that cement slurry or other fluids from inside or outside the releasing assembly 18 do not clog and interfere with the operation of the collet and releasing sleeve mechanism.

The top cementing plug 20 is threadedly connected to the lower end of the collet 42 at internal threads 60 thereof. The top cementing plug 20 includes a high strength inner tube 62 which is centrally positioned and extends short distances above and below the plug 20. The top portion of the inner tube 62 includes external threads 64 which are threadedly connected to the internal threads 60 of the collet 42. The inner tube 62 is preferably formed of a high strength but drillable material such as aluminum.

A solid insert 66, preferably formed of an easily drillable material such as a plastic material, is threadedly connected at threads 68 thereof to the threads 60 of the inner tube 62. An elastomeric jacket 70 is disposed around and attached to the insert 66 which includes a plurality of annular wipers 72 thereon for sealingly engaging the inner surface of the pipe 12. As is well understood by those skilled in the art, the wipers 72 extend outwardly and angularly upwardly into contact with the inner surface of the pipe 12 and function to wipe fluid from the walls of the pipe 12 and prevent mixing of that fluid with the fluid following the plug.

The high strength inner tube 62 of the top plug 20 includes an upper bore 74 and an enlarged lower bore 76 connected by an annular beveled shoulder 78. The lower portion of the inner tube 62 which includes the beveled shoulder 78 and the enlarged bore 76 form a part of the second fluid pressure activated releasing assembly 22. The lower portion of the inner tube 62 is also adapted to supportingly engage the high strength inner tube 80 of the bottom cementing plug 24 when the top cementing plug 20 lands on the bottom plug 24 as will be further described hereinbelow.

The bottom cementing plug 24 includes a high strength inner tube 80 which is centrally positioned and extends short distances above and below the bottom plug 24. Like the top plug 20, the inner tube 80 of the bottom plug 24 is preferably made of high strength aluminum. Also, the bottom plug 24 includes an insert 82, preferably formed of plastic material, threadedly connected to the inner tube 80 at a threaded connection 84. An elastomeric jacket 86 is disposed around and attached to the insert 82 which includes a plurality of wipers 88 for sealingly engaging the inner surface of the pipe 12.

As mentioned, the upper end of the inner tube 80 of the bottom plug 24 is adapted to supportingly engage the lower end of the inner tube 62 of the top plug 20. That is, the upper end of the bottom plug inner tube 80 includes a beveled shoulder 89 which is complimentary in size and shape to the beveled shoulder 78 of the top plug inner tube 62. Further, the bottom plug inner tube 80 has an outside size and shape complimentary to the inside size and shape of the lower bore 76 of the top plug inner tube 62 whereby the upper end of the bottom plug inner tube 80 fits snugly within the lower end of the top plug inner tube 62.

In the initial position as shown in FIG. 1, the upper end of the bottom plug inner tube 80 is maintained in engagement with the lower end of the top plug inner tube 62 by at least one shear pin 94 (two are shown) which are engaged with the inner tube 62 and extend into complimentary recesses 95 in the inner tube 80.

The bottom plug inner tube 80 includes an internal annular beveled shoulder 90 for retaining and sealing a sealing member, such as a ball, when the sealing member is caused to move through the drill string 16 and through the top plug inner tube 62 into the open end 92 of the inner tube 80. As will be further described, when the sealing member is present within the top end of the inner tube 80, a fluid pressure can be exerted across the sealing member which causes the shear pins 94 to shear and the bottom plug 24 to be released.

The upper end of the bottom plug inner tube 80 also preferably includes at least one opening 96 (two are shown) through a side thereof. Sealingly attached across the openings 96 are fluid pressure rupturable members 98. The rupturable members 98 are designed to rupture at a particular fluid pressure whereby after the bottom plug 24 has landed, increased fluid pressure exerted on it causes the rupture of the rupturable members 98 and cement slurry to flow through the bottom plug 24.

A pressure equalizing passage 100 extends from the internal beveled shoulder 90 through a side of the bottom plug inner tube 80, and O-ring seals 102 and 104 are disposed in grooves in the inner tube 80 above and below the pressure equalizing passage 100 and the openings 96, respectively. The O-ring seals 102 and 104 and the pressure equalizing passage 100 insure that a significant pressure differential is not exerted across the rupturable members 98 until after the bottom plug 24 is released.

As will be understood by those skilled in the art, means other than the openings 96 and rupturable members 98 can be utilized to selectively allow cement slurry flow through the bottom plug 24 after it has landed. For example, the float collar or shoe can include valve means which operate when the bottom plug lands. Alternatively, the seal member used to seal the bottom plug 24 can be resilient, e.g., a resilient ball, whereby it can be forced through the inner tube 80 by fluid pressure differential exerted on it.

The lower end of the inner tube 80 of the bottom plug 24 is adapted to supportingly engage a high strength member of the float collar or float shoe on which the bottom plug lands. That is, the lower end of the bottom plug inner tube 80 includes a beveled shoulder 106 for engaging a complimentary beveled shoulder in the float collar or shoe which will be described below. Also, an O-ring seal 108 is disposed in a groove in the exterior surface of the inner tube 80 adjacent the beveled shoulder 106 to provide a seal between the inner tube 80 and the interior of the float collar or shoe.

Figure 3:
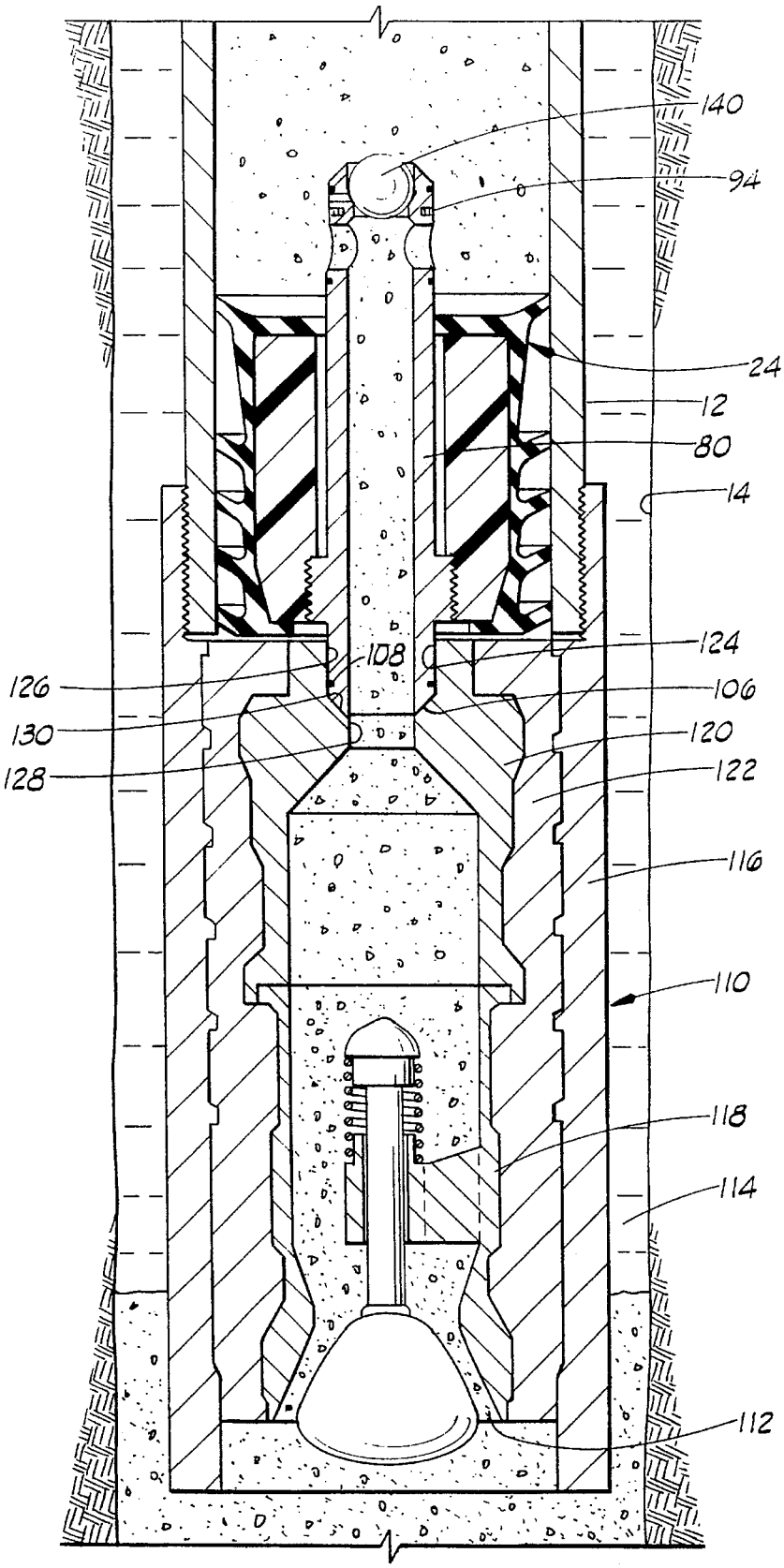
FIG. 3 is a cross-sectional view similar to FIG. 1 showing a float shoe attached at the bottom end of the pipe to be cemented after the bottom cementing plug has landed thereon.
Figure 5:
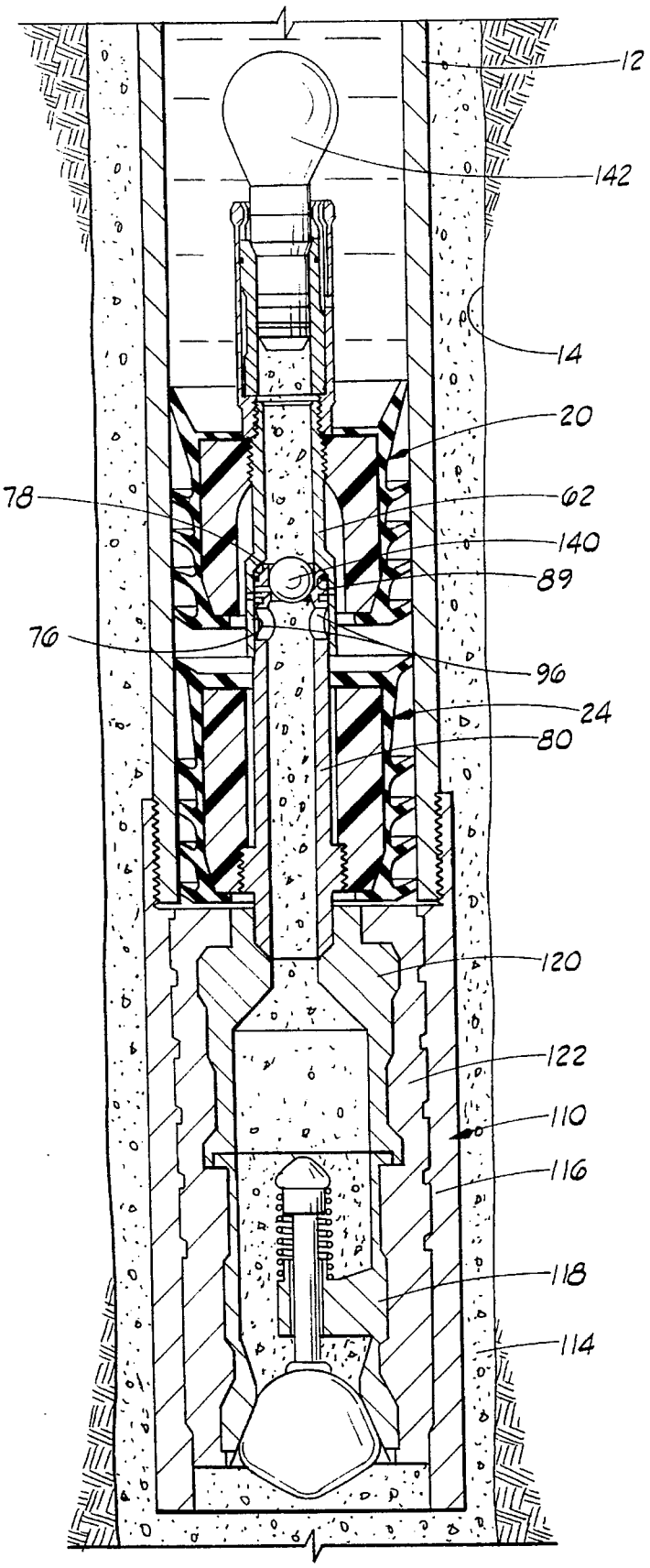
FIG. 5 is a cross-sectional view similar to FIG. 3 showing the float shoe and the top and bottom plugs after the top plug has landed.

The structure of a float shoe, generally designated by the numeral 110, which is suitable for use with the above described assembly 10 is illustrated in FIGS. 3 and 5. As will be understood, the float shoe 110 provides an opening 112 which opens into the annulus 114 between the pipe 12 and the walls of the well bore 14. As will also be understood, instead of the float shoe 110, a float collar or other similar device at the upper end of a shoe joint can be used. In still another embodiment, a guide shoe can be used.

In accordance with the present invention, the float shoe 110, or an equivalent float collar or other similar structure, includes an outer sleeve 116, a check-valve assembly 118 and a high strength inner tube 120 positioned above the check-valve assembly 118. The check-valve assembly 118 and the high strength inner tubular member 120 are held within the outer sleeve 116 by a cement portion 122. The opening 112 at the bottom end of the float shoe 110 is communicated with an opening 124 in the upper end thereof by the hollow interior of the check-valve assembly 118 and the hollow interior of the high strength inner tube 120.

The opening 124 in the upper end of the inner tube 120 of the float shoe 110 includes an enlarged upper bore 126 and a smaller bore 128 with a beveled shoulder 130 inbetween. As illustrated in FIGS. 3 and 5, when the bottom plug 24 lands on the float shoe 110, the lower end of the bottom plug inner tube 80 supportingly engages the upper end of the inner tube 120 of the float shoe 110. That is, the lower end of the bottom plug inner tube 80 is of a complimentary shape to the opening 124 of the float shoe inner tube 120 whereby the lower end of the bottom plug inner tube 80 fits snugly within the opening 124. In addition, the beveled shoulder 106 at the lower end of the bottom plug inner tube 80 supportingly contacts the beveled shoulder 130 of the float shoe inner tube 120. The O-ring 108 provides a seal between the bottom plug inner tube 80 and the float shoe inner tube 120.

OPERATION

Referring now to FIGS. 1–5, the operation of the subsurface release well cementing plug assembly 10 including the float shoe 110 will be described. As previously mentioned, both the pipe 12 to be cemented and the well bore 14 are usually filled with drilling mud prior to commencing primary cementing operations.

After positioning the plug assembly 10 within the well bore 14 and the pipe 12 disposed therein as shown in FIG. 1, a ball 140 or other equivalent sealing member is dropped into and caused to be moved in a known manner through the drill string 16, through the plug releasing assembly 18 and through the inner tube 62 of the top plug 20 into the open upper end of the inner tube 80 of the bottom plug 24.

Figure 2:
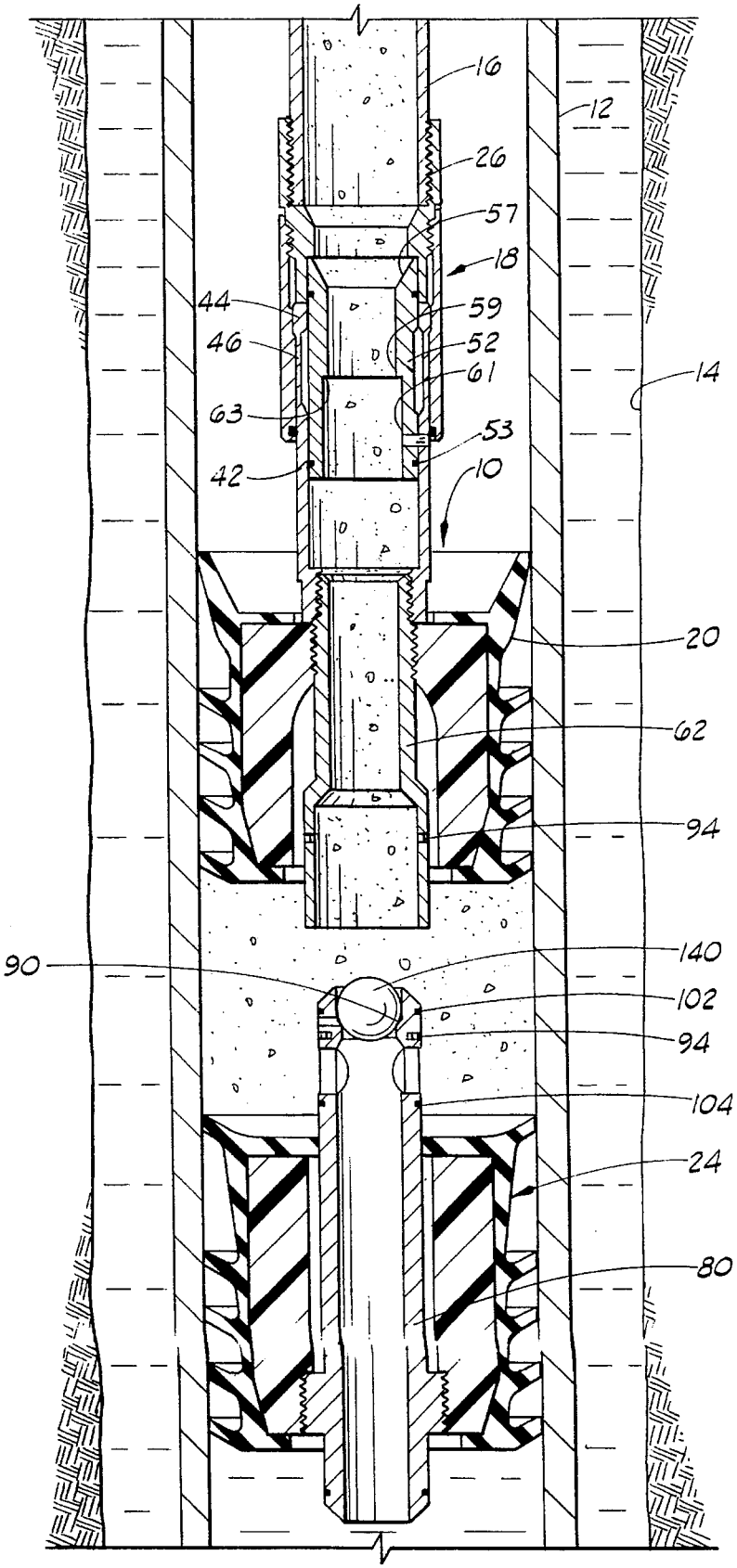
FIG. 2 is a cross-sectional view similar to FIG. 1 showing the sub-surface release cementing plug assembly after the release of the bottom plug.

Once the ball seal 140 is in place in the upper end of the bottom plug inner tube 80, the fluid pressure exerted across the seal is increased by pumping a fluid into the assembly 10 by way of the drill string 16 until the shear pins 94 shear and the bottom plug 24 is released from the top plug 20 as shown in FIG. 2. The ball seal 140 seals against the internal annular beveled shoulder 90 of the bottom plug inner tube 80, and as a result, closes the pressure equalizing passage 100.

After the bottom plug 24 is released as illustrated in FIG. 2, the cement slurry is continuously pumped into the interior of the pipe 12 by way of the drill string 16, the first releasing assembly 18 and the inner tube 62 of the top plug 20 which displaces the bottom plug 24 and the drilling mud ahead of the bottom plug 24 through the pipe 12.

As shown in FIG. 3, when the bottom plug 24 reaches the float shoe 110 at the bottom end of the pipe 12, the lower end of the bottom plug high strength inner tube 80 supportingly engages the upper end of the high strength inner tube 120 of the float collar 110. That is, the lower end of the inner tube 80 is moved into the opening 124 at the top of the float shoe inner tube 120 whereby the beveled shoulder 130 of the inner tube 80 is supported on the beveled shoulder 106 of the float shoe inner tube 120. The ball seal 140 remains in place within the upper end of the bottom plug inner tube 80.

When the bottom plug 24 lands on the float shoe 110, the pumping of the cement slurry is continued until the predetermined volume of cement slurry required for cementing the pipe 12 in the well bore 14 has been pumped into the pipe 12. As mentioned above, the continued pumping of the cement slurry after the bottom plug 24 lands causes the rupture of the rupturable members 98 of the bottom plug 24 whereby the cement slurry flows through the bottom plug into the annulus between the pipe 12 and the walls of the well bore 14.

When the predetermined volume of cement slurry has been pumped into the pipe 12, the plug releasing assembly 18 is activated whereby the top plug 20 and the cement slurry ahead of it are displaced through the pipe 12 and into the annulus by pumping drilling fluid or other available displacement fluid behind the top plug 20.

Figure 4:
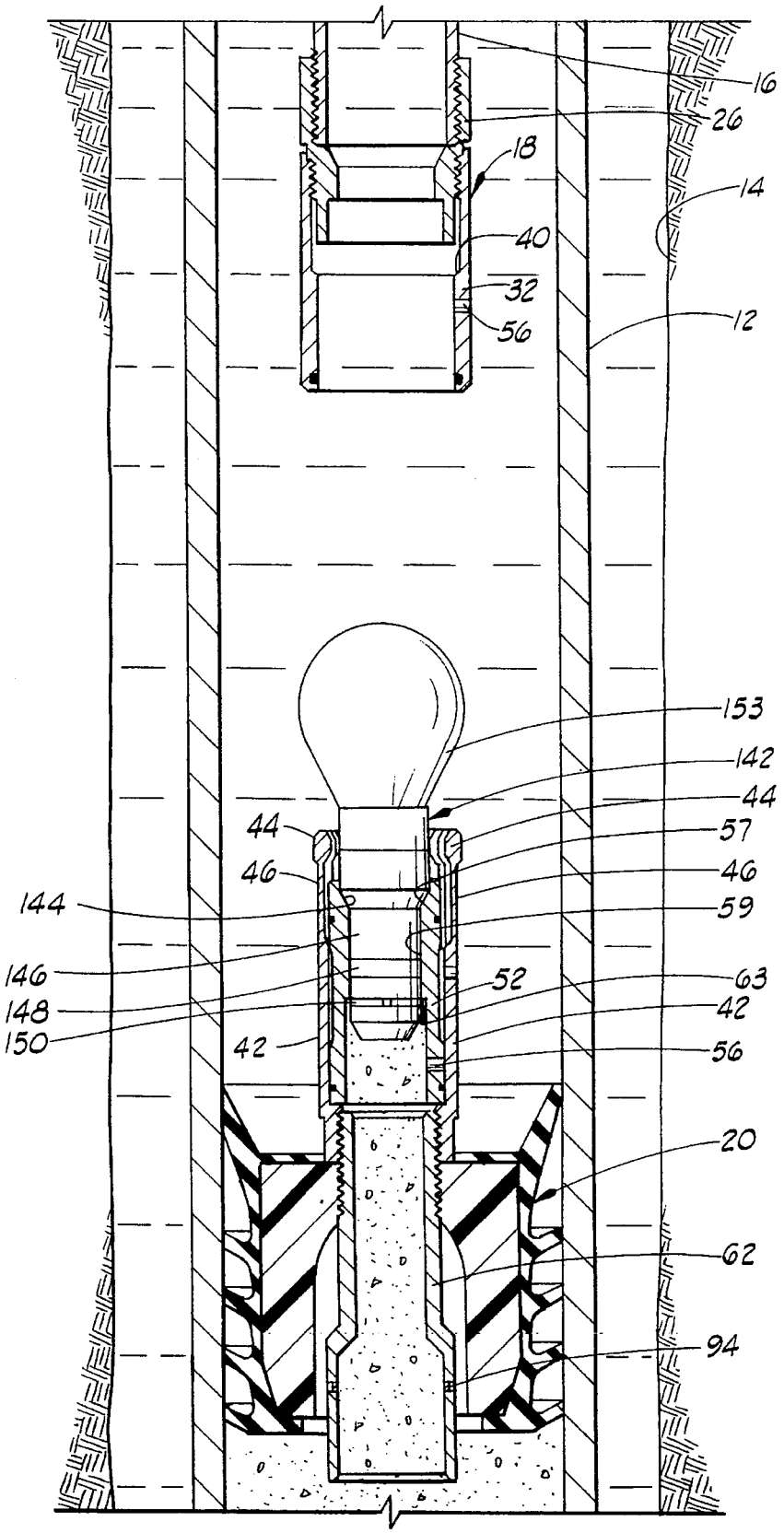
FIG. 4 is a cross-sectional view similar to FIG. 1 showing the sub-surface release cementing plug assembly shortly after the release of the top plug.

The release of the top plug 20 is accomplished by dropping an additional seal member into the drill string 16 and causing it to move into contact with the releasing sleeve 52 of the releasing assembly 18. As illustrated in FIG. 4, a seal member 142 known as a drill pipe plug can be utilized for releasing the top plug 20. Drill pipe plugs are known in the art and are designed to sealingly engage the inside surface of the drill string 16 and to sealingly close the hollow interior of the releasing sleeve 52. However, other seal members such as those commonly referred to as darts can be used in place of the drill pipe plug 142.

As illustrated in FIG. 4, the drill pipe plug 142 includes a beveled shoulder 44 which engages the beveled shoulder 57 of the releasing sleeve 52 and an elongated nose portion 146 which fits snugly within the bore 59 of releasing sleeve 52. A resilient seal ring 148 provides a seal between the nose portion 146 of the drill pipe plug 142 and the interior of the releasing sleeve 52. A snap ring 150 attached to the nose portion 146 of the plug 142 engages the shoulder 63 of the releasing sleeve 52 whereby the plug 142 is maintained within the releasing sleeve 52. The upper bulbus portion 153 of the plug 142 is formed of a resilient material and forms a seal against the inside surfaces of the drill string 16 and the internal parts of the releasing assembly 18 while the plug is being moved therethrough.

The engagement of the drill pipe plug 142 with the releasing sleeve 52 and the application of fluid pressure differential across the plug 142 after its engagement causes the releasing sleeve 52 to be moved from its upper collet finger retaining position illustrated in FIG. 2 to the lower collet finger releasing position illustrated in FIG. 4. When the releasing sleeve 52 has moved to its lower releasing position, the head portions 44 of the collet fingers 46 disengage from the annular shoulder 40 of the collet retainer 32 and the bottom plug 20 is released and moved downwardly as shown in FIG. 4.

The continued pumping of the displacement fluid behind the top plug 20 displaces the plug 20 and the cement slurry ahead of the plug 20 through the interior of the pipe 12 and into the annulus 114 between the pipe 12 and the walls of the well bore 14 as shown in FIG. 5. When the top plug 20 reaches the bottom of the pipe 12, it lands on the plug 24 as is also shown in FIG. 5. Upon landing, the enlarged bore 76 in the lower end of the top plug inner tube 62 is supportingly engaged by the upper end of the bottom plug inner tube 80 as previously described. That is, the beveled shoulder 89 on the upper end of the bottom plug inner tube 80 supportingly engages the beveled shoulder 78 in the top plug inner tube 62. Additionally, the upper portion of the bottom plug inner tube 80 fits snugly within the lower end portion of the top plug inner tube 62. The openings 96 in the inner tube 80 are closed as a result of being covered by the lower end portion of the inner tube 62.

As mentioned above, after the top plug 20 lands on the bottom plug 24, the pressure exerted on the plugs is normally increased to pressure test the pipe 12 and other associated equipment for leaks, etc. However, the high pressure differential exerted on the plugs 20 and 24 is supported by the high strength inner tube 62 of the top plug 20 and the high strength inner tube 80 of the bottom plug 24, both of which are supported by the high strength inner tube 120 of the float shoe 110. As a result, the plugs 20 and 24 are prevented from being damaged.

After the top plug 20 has been landed and the pressure test of the pipe 12 and associated equipment has been performed, the cement slurry in the annulus 114 is allowed to set whereby the pipe 12 is cemented in the well bore 14. If the well bore 14 is to be extended by additional drilling below the end of the pipe 12, or if it is otherwise desirable to remove the plug assembly 10 and the internals of the float shoe 110, the plug assembly 10 and the internals of the float shoe 110 are drilled out of the pipe 12 and out of the float shoe sleeve 116 utilizing conventional drilling techniques.

Figure 6:
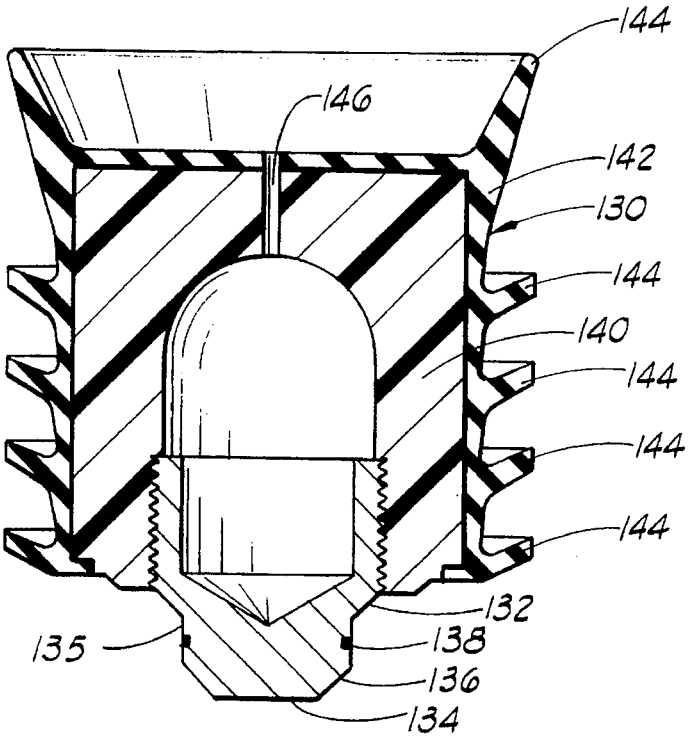
FIG. 6 is a side cross-sectional view of a top above-surface release cementing plug of the present invention.
Figure 7:
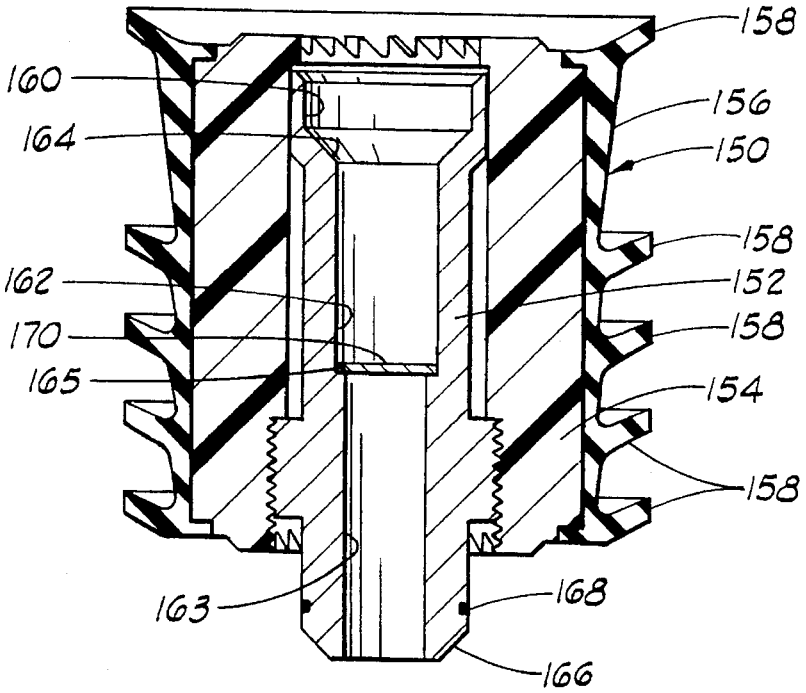
FIG. 7 is a side cross-sectional view of a bottom above-surface release cementing plug of the present invention which is utilized with the top plug of FIG. 6.

Referring now to FIGS. 6 and 7, above-surface release well cementing top and bottom plugs of the present invention are illustrated. That is, an above-surface release top plug, generally designated by the numeral 130, is illustrated in FIG. 6, and an above-surface release bottom plug, generally designated by the numeral 150, is illustrated in FIG. 7.

Referring to FIG. 6, the top plug 130 is comprised of a centrally positioned inner tube 132 formed of a high strength material such as aluminum. The lower end 134 of the tube 132 is closed, and the lower end portion 135 of the tube 132 is of a reduced diameter and extends below the plug 130. The lower end 134 of the tube 132 includes an annular beveled shoulder 136 formed thereon, and an O-ring seal 138 is positioned in a groove adjacent the shoulder 136.

A hollow insert 140, preferably formed of a plastic material, is threadedly connected to the inner tube 132, and an elastomeric jacket 142 is disposed around and attached to the insert 140. The elastomeric jacket 142 includes a plurality of wipers 144 thereon for sealingly engaging the inner surface of a pipe to be cemented in a well bore. A pressure equalizing passage 146 communicates and equalizes the fluid pressure exerted on top of the plug 130 with the interior of the insert 140 and the interior of the inner tube 132 threadedly attached thereto.

Referring now to FIG. 7, the bottom cementing plug 150 includes an inner tube 152 formed of a high strength material such as aluminum. An insert 154, preferably formed of a plastic material, is threadedly attached to the inner tube 152. An elastomeric jacket 156 is disposed around and attached to the insert 154 which includes a plurality of wipers 158.

The inner tube 152 includes an enlarged bore 160 at the upper open end thereof and a smaller bore 162 therebelow with a beveled shoulder 164 inbetween. A third bore 163 which is smaller than the bore 162 and forms an upwardly facing shoulder 165 extends to the bottom open end of the inner tube 152. The bore 160 and the beveled shoulder 164 at the upper end of the bottom plug inner tube 152 are of complimentary sizes and shapes to the beveled shoulder 136 and the lower end portion 135 of the top plug inner tube 132. Thus, the upper end of the bottom plug inner tube 152 is adapted to supportingly engage the lower end of the top plug inner tube 132 when the top plug 130 lands on the bottom plug 150. That is, the lower portion 135 of the top plug inner tube 132 fits snugly within the bore 160 in the upper portion of the bottom plug inner tube 152, and a seal is provided therebetween by the O-ring 138.

The lower end of the bottom plug inner tube 152 includes a beveled shoulder 166 and an O-ring 168 disposed in a groove positioned adjacent to the beveled shoulder 166. Thus, the lower end of the bottom plug inner tube 152 is adapted to be supported by a float shoe or equivalent structure like the float shoe 110 described above. The bottom plug inner tube 152 is closed by a fluid pressure rupturable member 170 seated on the shoulder 165 between the bores 162 and 163.

The operation of the above-surface release well cementing plugs 130 and 150 is identical to the sub-surface well cementing plugs 20 and 24 described above except that the above-surface release plugs 130 and 150 are manually released from a plug container positioned above the surface in communication with the interior of the pipe to be cemented.

When the bottom plug 150 lands on a float shoe like the float shoe 110 illustrated in FIGS. 3 and 5 and described above, the rupturable member 170 closing the plug 150 is ruptured by increased fluid pressure and cement slurry flows through the plug 150 into the annulus.

When the top plug 130 lands on the bottom plug 150, the inner tube 132 of the top plug 130 is supportingly engaged by the bottom plug inner tube 152. That is, the lower end of the top plug inner tube 132 extends into the upper end portion of the bottom plug inner tube 152 whereby the beveled shoulder 136 of the inner tube 132 is in contact with and supported by the beveled shoulder 164 of the inner tube 152. The O-ring 138 provides a seal between the inner tubes 132 and 152.

The support of the top plug inner tube 132 by the bottom plug inner tube 152 which are both in turn supported by a high strength inner tube of a float shoe or the like prevent damage to the plugs 130 and 150 as a result of high differential pressures exerted thereon.

Thus, the present invention is well adapted to carry out the objects and attain the ends and advantages mentioned as well as those which are inherent therein. While numerous changes in the construction and arrangement of parts may be made by those skilled in the art, such changes are encompassed within the spirit of this invention as defined by the appended claims.

What is claimed is:

1. A high pressure well cementing plug assembly for use in a pipe during the cementing of the pipe in a well bore, the pipe including a float shoe or the like on which the plug assembly lands, comprising:

a top cementing plug means having a high strength inner tube attached to and extending through the bottom thereof for supporting differential pressure exerted on said top plug means;

a bottom cementing plug means having a high strength inner tube attached thereto and extending therethrough for supporting differential pressure exerted on said bottom plug means;

said float shoe including a high strength inner tube extending through the top thereof;

the bottom end of said high strength inner tube of said bottom plug means and the top end of said high strength inner tube of said float shoe being adapted to supportingly and sealingly engage each other when said bottom plug means lands on said float shoe; and the bottom end of said high strength inner tube of said top plug means and the top end of said high strength inner tube of said bottom plug means being adapted to supportingly and sealingly engage each other when said top plug means lands on said bottom plug means.

2. The cementing plug assembly of claim 1 wherein said bottom plug means includes a rupturable member disposed over an opening in said inner tube thereof for preventing flow through said inner tube until said rupturable member is caused to rupture.

3. The cementing plug assembly of claim 2 wherein said top and bottom plug means each comprise:

a solid insert attached to said high strength inner tube of said plug means; and an elastomeric jacket disposed around said insert, said jacket having a plurality of wipers thereon for sealingly engaging an inner surface of said pipe.

4. The cementing plug assembly of claim 3 wherein said high strength inner tube of said plug means is made from aluminum and said insert is made from plastic material.

5. A sub-surface release high landing pressure well cementing plug assembly for use in a pipe during the cementing of the pipe in a well bore, the pipe including a float shoe or the like on which the plug assembly lands, comprising:

a top cementing plug means having a high strength inner tube attached thereto and extending therethrough for supporting differential pressure exerted on said plug means;

first fluid pressure activated releasing means releasably connecting the top end of said inner tube of said top plug means to a drill string;

a bottom cementing plug means having a high strength inner tube attached thereto and extending therethrough for supporting differential pressure exerted on said bottom plug means;

second fluid pressure activated releasing means releasably connecting the top end of said inner tube of said bottom plug means to the bottom end of said inner tube of said top plug means;

said float shoe including a high strength inner tube extending through the top thereof;

the bottom end of said high strength inner tube of said bottom plug means and the top end of said high strength inner tube of said float shoe being adapted to supportingly and sealingly engage each other when said bottom plug means lands on said float shoe; and the bottom end of said high strength inner tube of said top plug means and the top end of said high strength inner tube of said bottom plug means being adapted to supportingly and sealingly engage each other when said top plug means lands on said bottom plug means.

6. The cementing plug assembly of claim 5 wherein the top end of said inner tube of said bottom plug means is adapted to receive a first seal means dropped into and moved through said drill string and through the inner tube of said top plug means whereby the fluid pressure differential across said seal means can be increased thereby activating said second fluid pressure activated releasing means to release said bottom plug means.

7. The cementing plug assembly of claim 6 wherein said inner tube of said bottom plug means further comprises:

at least one opening through a side of said inner tube adjacent the top end thereof; and a fluid pressure rupturable member sealingly attached across said opening whereby upon the landing of said bottom plug means, said rupturable member can be ruptured and fluid caused to flow through said inner tube of said bottom plug means by raising the fluid pressure exerted on said bottom plug means to thereby rupture said rupturable member.

8. The cementing plug assembly of claim 7 wherein said first fluid pressure activated releasing means is adapted to sealingly receive a second seal means dropped into and moved through said drill string whereby the fluid pressure differential across said seal means can be increased thereby activating said first fluid pressure activated releasing means to release said top plug means.

9. The cementing plug assembly of claim 8 wherein said top and bottom plug means each comprise:

a solid insert attached to the high strength inner tube of said plug means; and an elastomeric jacket disposed around said insert, said jacket having a plurality of wipers thereon for sealingly engaging an inner surface of said pipe.

10. The cementing plug assembly of claim 9 wherein said high strength inner tube of said plug means is made from aluminum.

11. The cementing plug assembly of claim 10 wherein said insert is made from plastic material.

12. A sub-surface release high landing pressure well cementing plug assembly for use in a pipe during the cementing of the pipe in a well bore comprising:

a top cementing plug means having a high strength inner tube attached thereto and extending therethrough for supporting differential pressure exerted on said plug means;

first fluid pressure activated releasing means releasably connecting the top end of said inner tube of said top plug to a drill string;

a bottom cementing plug means having a high strength inner tube attached thereto and extending therethrough for supporting differential pressure exerted on said bottom plug means;

second fluid pressure activated releasing means releasably connecting the top end of said inner tube of said bottom plug means to the bottom end of said inner tube of said top plug means;

the bottom end of said inner tube of said top plug means and the top end of said inner tube of the bottom plug means being adapted to supportingly and sealingly engage each other when said top plug means lands on said bottom plug means;

a float shoe means connected to said pipe having a high strength inner tube extending through the top thereof; and the bottom end of said high strength inner tube of said bottom plug means and the top end of said high strength inner tube of said float shoe being adapted to supportingly and sealingly engage each other when said bottom plug means lands on said float shoe.

13. The cementing plug assembly of claim 12 wherein the top end of said inner tube of said bottom plug means is adapted to sealingly receive a first seal means dropped into and moved through said drill string and through the inner tube of said top plug means whereby the fluid pressure differential across said seal means can be increased thereby activating said second fluid pressure activated releasing means to release said bottom plug means.

14. The cementing plug assembly of claim 13 wherein said inner tube of said bottom plug means further comprises:

at least one opening in a side of said inner tube adjacent the top end thereof; and a fluid pressure rupturable member sealingly attached across said opening whereby upon the landing of said bottom plug means, said rupturable member can be ruptured and fluid caused to flow through said inner tube of said bottom plug means by raising the fluid pressure exerted on said bottom plug means to thereby rupture said rupturable member.

15. The cementing plug assembly of claim 14 wherein said first fluid pressure activated releasing means is adapted to sealingly receive a second seal means dropped into and moved through said drill string whereby the fluid pressure differential across said second seal means can be increased thereby activating said first fluid pressure activated releasing means to release said top plug means.

16. The cementing plug assembly of claim 15 wherein said top and bottom plug means each comprise:

a solid insert attached to the high strength inner tube of said plug means; and an elastomeric jacket disposed around said insert, said jacket having a plurality of wipers thereon for sealingly engaging an inner surface of said pipe.

17. The cementing plug assembly of claim 16 wherein said high strength inner tube of said plug means is made from aluminum.

18. The cementing plug assembly of claim 17 wherein said insert is made from plastic material.

* * * * *